US005388540A

United States Patent [19]

Satoma

[11] Patent Number: 5,388,540

[45] Date of Patent: Feb. 14, 1995

[54] SAFETY DEVICE FOR SEWING MACHINE

[75] Inventor: Shiro Satoma, Chofu, Japan

[73] Assignee: JUKI Corporation, Chofu, Japan

[21] Appl. No.: 40,672

[22] Filed: Mar. 31, 1993

[30] Foreign Application Priority Data

Mar. 31, 1992 [JP] Japan ..... 4-018715[U]

[51] Int. Cl.[6] ..... D05B 83/00

[52] U.S. Cl. ..... 112/277; 112/261

[58] Field of Search ..... 112/277, 261, 258, 199, 112/197, 200, 165, 166, 162; 192/129 A, 130, 135

[56] References Cited

U.S. PATENT DOCUMENTS 4,295,421 10/1981 Abendroth et al. ..... 192/130 X 4,498,078 2/1985 Yoshimura et al. ..... 112/277 X 5,233,935 8/1993 Winter ..... 112/261 X

FOREIGN PATENT DOCUMENTS 54-87253 6/1979 Japan .

2-14784 7/1988 Japan .

*Primary Examiner*—Peter Nerbun

*Attorney, Agent, or Firm*—Morgan & Finnegan

[57] ABSTRACT

A safety device for sewing machines such as an overlock sewing machine and the like including a stopper secured to the sewing machine, a lever pivoted to a looper cover, a pin, a spring provided thereon, and engageable members formed on a chip guard cover and an auxiliary bed, respectively. A switch is so mounted on the sewing machine as to render the latter actuated when it is in contact with the looper cover.

9 Claims, 5 Drawing Sheets

SAFETY DEVICE FOR SEWING MACHINE

BACKGROUND OF THE INVENTION

1. Field of the Invention

This invention relates to a safety device for sewing machines such as an overlock sewing machine and the like, and more particularly to a safety mechanism which is adapted to prevent the sewing machine from being inadvertently driven when loopers mounted in the sewing machine are exposed.

2. Description of the Prior Art

An overlock sewing machine with a conventional safety device as shown in FIG. 5 includes a needle N for feeding a sewing thread to a work piece, and upper and lower loopers 1 and 2 for supplying upper and lower threads to form stitches in cooperation with each other. An overlock sewing machine of this class is arranged not only to form overedge stitches S1 by overedging the workpiece as shown in FIG. 6 but also to make double chain stitches S2 as illustrated in FIG. 7.

Formation of the overedge stitches S1 requires setting a chip guard cover 3 (FIG. 5) to a looper cover 5 of the sewing machine. Formation of the double chain stitches S2 requires setting an auxiliary bed 4 (FIG. 8) to a looper cover 5 of the sewing machine.

The looper cover 5 is so mounted on the overlock sewing machine enabling it to be opened and closed. In the overlock sewing machine, as shown in FIG. 5, the looper cover 5 is brought into a closed condition by pulling it toward the operator after the looper cover 5 has been horizontally moved (rightward in FIG. 5). The looper cover 5 serves not only to facilitate setting the threads to the upper and lower loopers 1 and 2 but also to properly protect the upper and lower loopers therewith, which repeatedly moves reciprocally at a high speed on the order of 1,500 rpm during the sewing operation.

In order to ensure safety of the operator, a safety device 10 (FIG. 9) is provided in the overlock sewing machine which is arranged so that the sewing could not actuate unless the looper cover 5 and the chip guard cover 3 (FIG. 5) or the auxiliary bed 14 are properly fitted to the sewing machine. In other words, the sewing machine may be actuated only when the looper cover and chip guard cover or auxiliary bed are properly set.

As is apparent from FIG. 9, the safety device 10 mounted in the overlock sewing machine consists of a safety switch S', an operative lever 11, and a transmission wire 12 in a tube. The safety switch S' is turned to the ON or OFF position to energize or deenergize a drive motor (not shown) provided for driving the sewing machine. The switch controls the sewing machine to render it actuated or not actuated. The operative lever 11 on the looper cover 5 comprises a rod **11*a* which moves reciprocally, and a spring 11*b* anchored between opposite ends of the rod 11*a* to forwardly urge the rod 11*a*. The transmission wire 12 is received in a tube or sleeve disposed on a cloth plate cover 14 and includes one end opposed to the safety switch S' and the other end facing the operative lever 11**.

According to the safety device 10 (FIG. 9) arranged as aforementioned, the rod **11*a* of the operative lever 11 abuts against one end of the transmission wire 12 so that the other end of the transmission wire 12 is allowed to bring the safety switch S' into the ON position only when the looper cover 5 and the cloth plate cover 14** are properly set. This renders the sewing machine actuated.

A disadvantage of a conventional safety device is complicated fabrication which is unable to accommodate the transmission wire 12 and the like therein thus entailing a higher production cost due to expensive pans.

A further disadvantage is that the sewing machine must afford more space to accommodate therein the longitudinally extending transmission wire 12 thereby involving difficulty in mounting the chip guard cover 3 and the auxiliary bed 4 and decreasing efficiency of the sewing machine.

A still further disadvantage is that the sewing machine is susceptible to inadvertent movement thus entailing danger to the operator when the looper cover is not well fitted to the frame of the sewing machine.

SUMMARY OF THE INVENTION

It is, therefore, an object of the invention to provide a safety device for sewing machines, such as an overlock sewing machine and the like, which is capable of overcoming the aforementioned disadvantages.

A further object of the invention is to provide a safety device for sewing machines which not only ensures safety of the operator but also improves the work efficiency.

A further object of the invention is to provide a safety device for sewing machines which facilitates setting a chip guard cover or auxiliary bed and a looper cover.

A further object of the invention is to provide a safety device for sewing machines which requires neither complicated pans nor members, rendering the device as a whole inexpensive to produce.

A further object of the invention is to provide a safety device for sewing machines which is capable of saving labor and time required for driving the sewing machine.

These and other objects of the invention are accomplished by providing a safety device for the sewing machines which comprises a stopper rigidly mounted on a frame of said sewing machine, engageable members provided on said chip guardcover and said auxiliary bed, respectively, means for retaining said looper cover in an open condition by said stopper when said chip guard cover or said auxiliary bed is removed out of said looper cover and for releasing said looper cover from said retention by said engageable member to allow said looper cover to be movable when said chip guard cover or said auxiliary bed is fitted to said looper cover, and a switch for generating a signal capable of starting said sewing machine in a position where said looper cover is closed.

BRIEF DESCRIPTION OF THE DRAWINGS

The invention will be described in greater detail below by way of reference to the accompanying drawings, wherein.

DETAILED DESCRIPTION OF THE DRAWINGS

Figure 1:
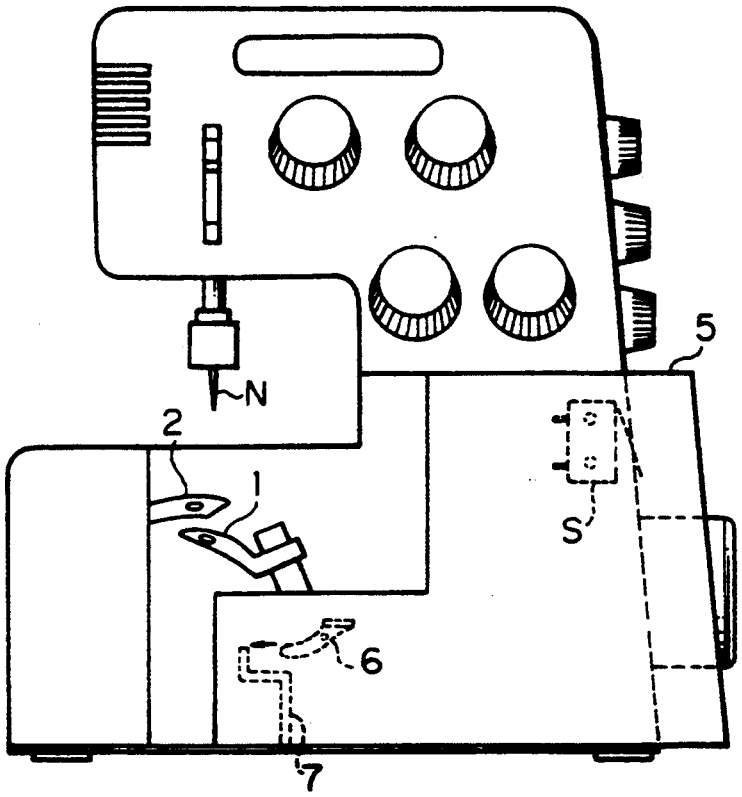
FIG. 1 is a representation schematically showing a safety device for an overlock sewing machine embodying the present invention.

The invention will be described hereinafter in conjunction with the accompanying drawings, particularly FIGS. 1 through 4, wherein like reference characters designate like or corresponding parts throughout the views.

Referring to FIG. 1, a safety switch S is so disposed on a frame of a sewing machine, which is opposed to a contact segment (not shown) attached to a looper cover 5. The safety switch S is turned ON to render the sewing machine operable only when the looper cover 5 is properly set to the frame of the sewing machine.

Figure 2:
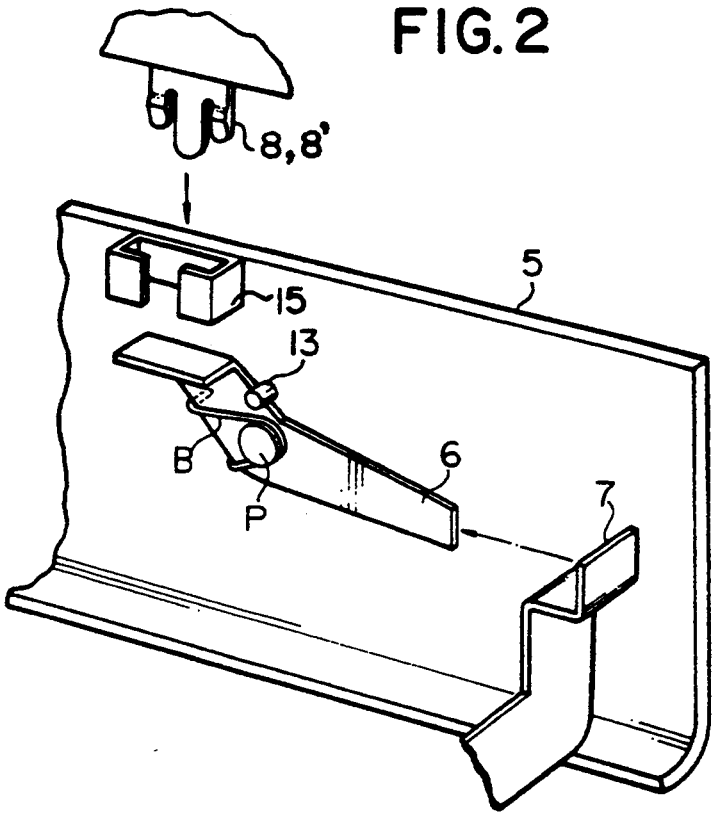
FIG. 2 is a perspective view fragmentarily showing the safety device, which is explanatory of the relationship between a lever disposed on a looper cover and a stationary segment attached to a frame of the sewing machine.

A safety mechanism is partly shown in perspective in FIG. 2 and includes a lever 6 which is mounted on the looper cover 5 on the other side thereof and rotatable about a hinge pin P. A spring B is provided to energize the lever 6 for urging the lever 6 in the direction of a pin 13 where the former is engaged by the latter at which time one end of the lever 6 is positioned to be opposed to a stationary segment or stopper 7.

Figure 3:
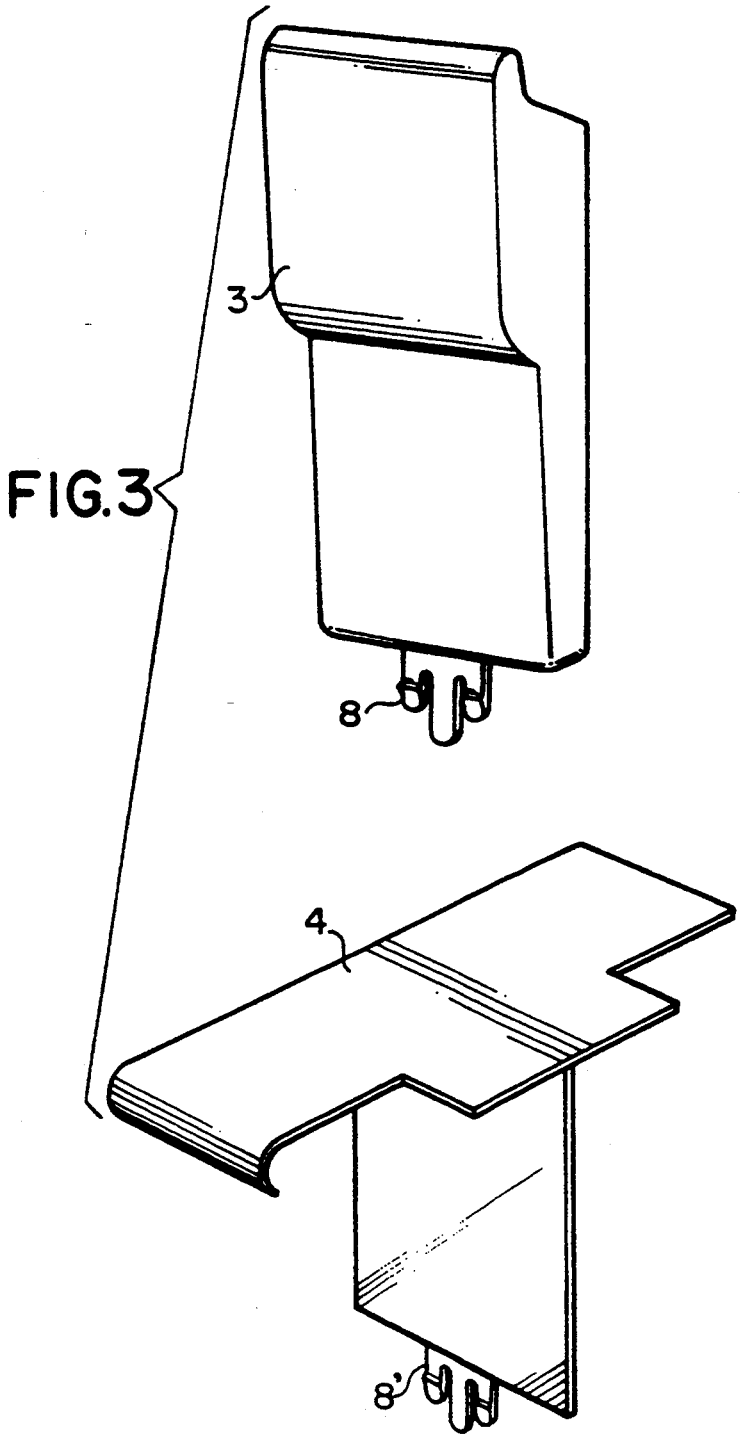
FIG. 3 is a perspective view exaggeratively showing a chip guard cover and an auxiliary bed which are provided downwardly thereof with tongues, respectively.
Figure 4:
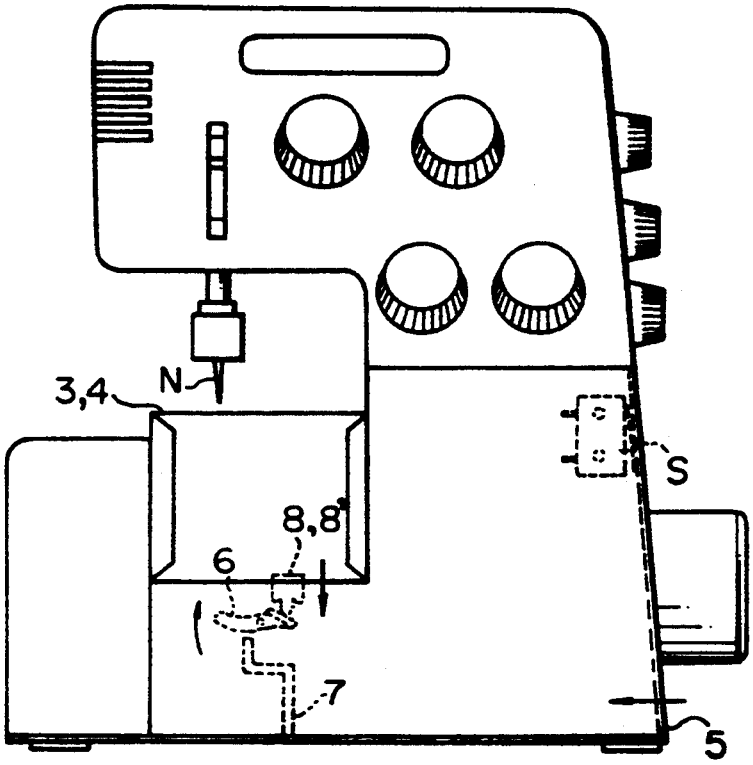
FIG. 4 is a representation schematically showing an overlock sewing machine which is ready for sewing operation when a chip guard cover or an auxiliary bed is set to a body of the sewing machine.
Figure 5:
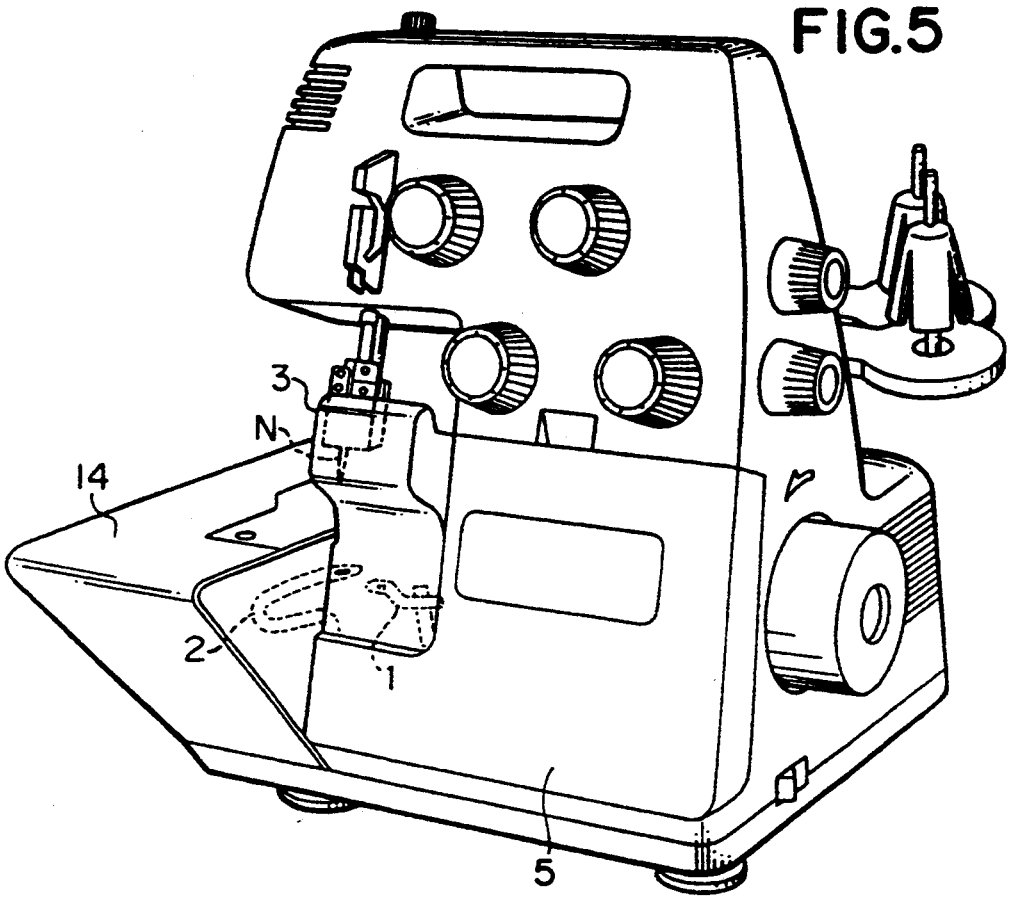
FIG. 5 is a perspective view showing an overlock sewing machine of a conventional type to which the chip guard cover is set.
Figure 6:
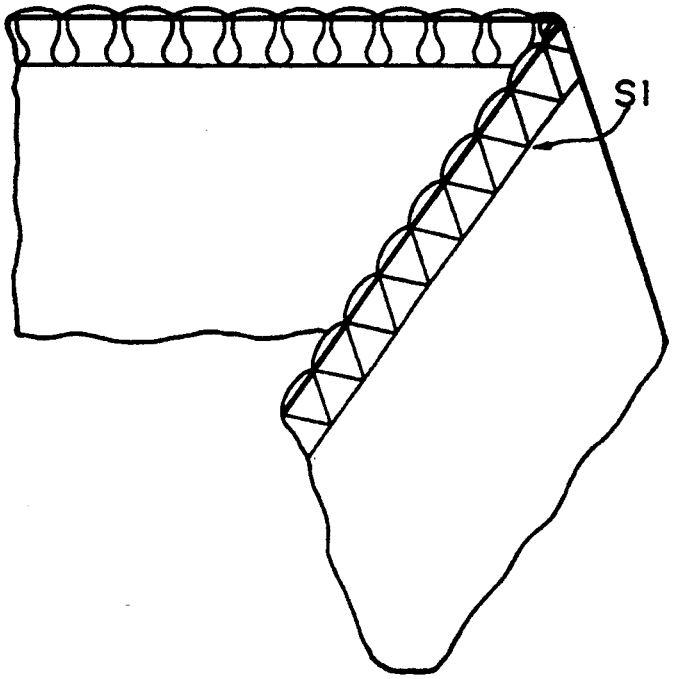
FIG. 6 is a perspective view fragmentally showing a workpiece as seamed by overedge stitches.
Figure 7:
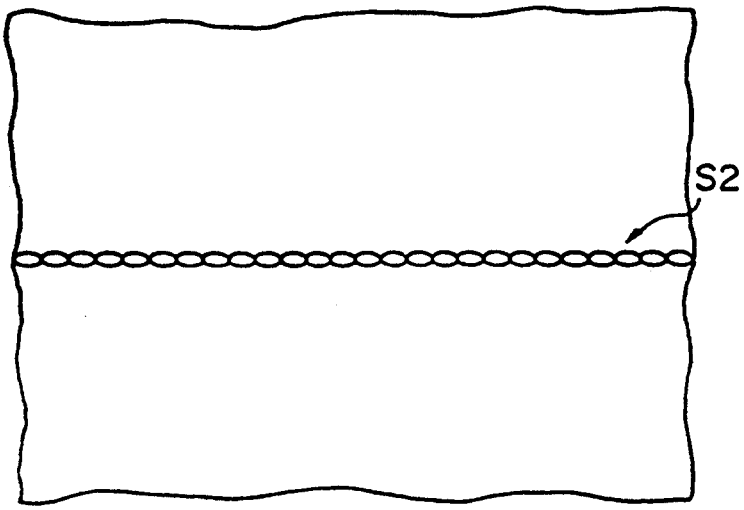
FIG. 7 is a front view fragmentally showing the workpiece as seamed by double chain stitches.
Figure 8:
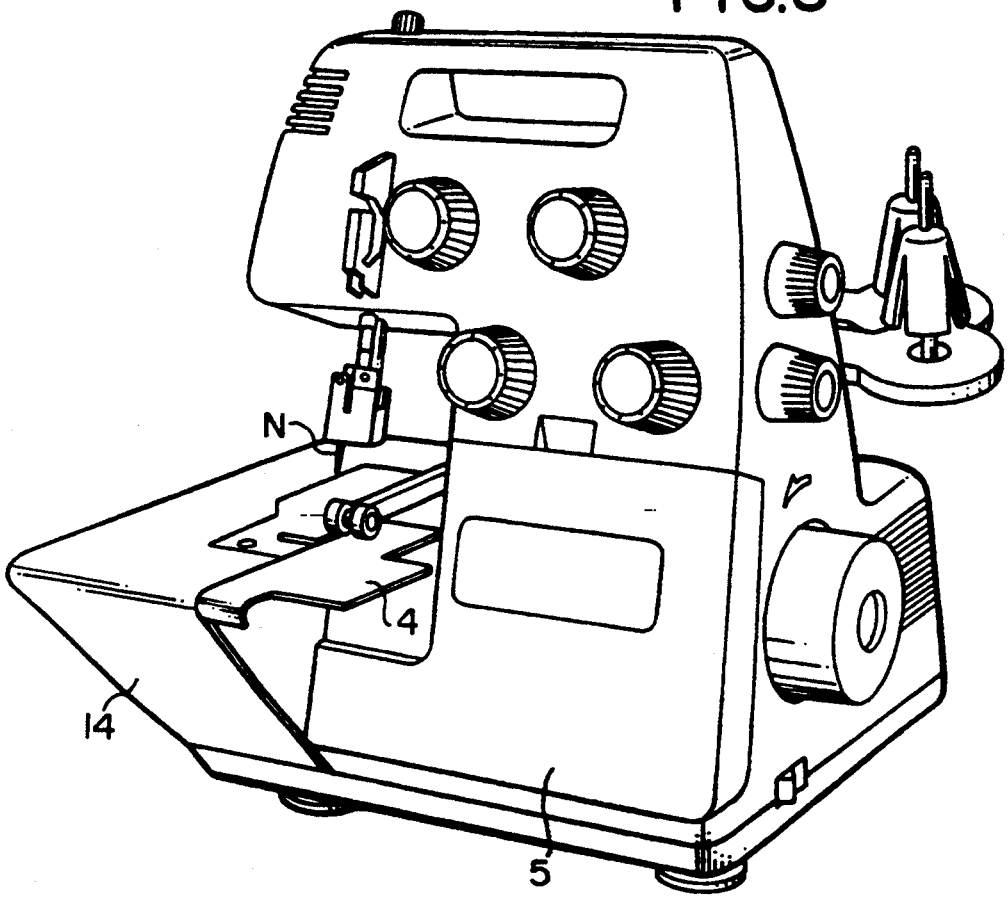
FIG. 8 is a perspective view showing the overlock sewing machine of a conventional type to which the auxiliary bed is set.
Figure 9:
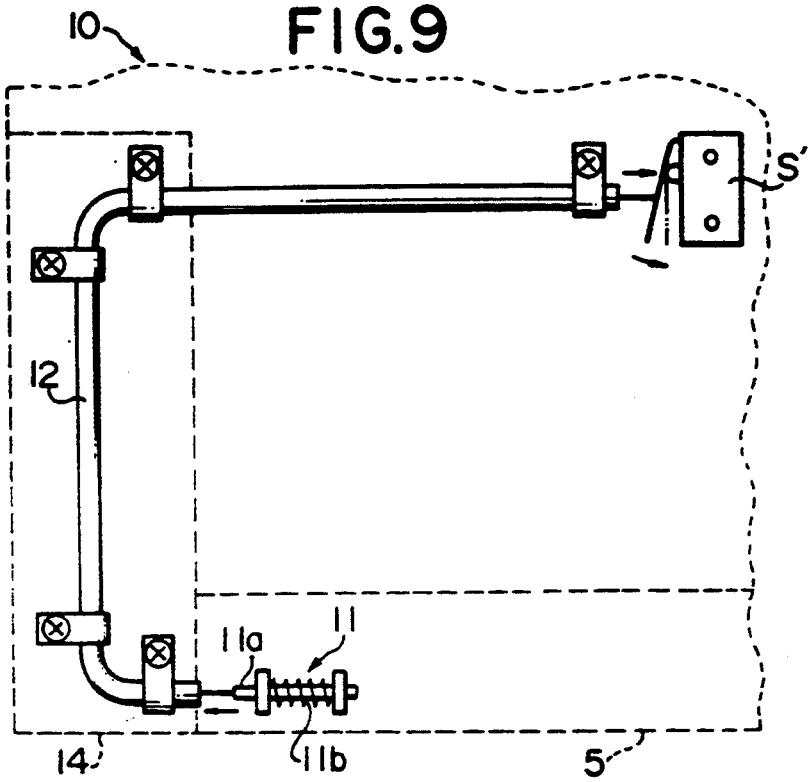
FIG. 9 is a representation schematically showing a conventional safety device as arranged in the body of the overlock sewing machine.

As is best shown in FIG. 3, a chip guard cover 3 and an auxiliary bed 4 are formed with engageable tongues 8,8' downwardly thereof, respectively. Each of the tongues 8,8' when the looper cover 5 is set, is fitted in and supported on a support in the form of a bracket 15 (FIG. 2) which is formed on the looper cover 5 on the other side thereof to allow one end of tongues 8,8', as shown in FIG. 4, to abut against the other end of the lever 6 so that the lever 6 is so rotated against the bias of the spring B as to keep the lever 6 away from a position where its one end is opposite to the stopper 7.

The safety device fabricated as aforementioned is so arranged that the safety switch S is not turned ON, preventing the overlock sewing machine from being actuated, when the looper cover is not brought into a proper closed condition.

When the chip guard cover 3 or the auxiliary bed 4 is not set to the looper cover 5, the lever 6 is engaged by the pin 13 to render the one end of the lever opposite to the stopper 7 so that the looper cover 5 is prevented from being closed, that is, the overlock sewing machine is prevented from being driven by engagement of the lever 6 with the stopper 7 even if the looper cover 5 is moved from the open condition to the closed condition.

In contrast, when the chip guard cover 3 or the auxiliary bed 4 is set to the looper cover 5, the overlock sewing machine may be brought into the drive condition by so moving the looper cover to a closed position since each of the tongues 8,8' formed on the looper cover 3 and the auxiliary bed 4 is allowed to abut against an end of the lever 6 thereby moving the other end of the lever 6 by rotation and separating it from a position opposite the stationary segment or stopper 7.

As set forth hereinbefore, the safety device according to the present invention is not enabled to close the looper cover unless either the chip guard cover 3 or the auxiliary bed 4 is set to the looper cover 5. Further, the overlock sewing machine is capable of being driven only when the looper cover 5 is brought by the safety switch S into a closed condition in a proper manner.

Although the invention has been described by way of reference to the embodiments disclosed herein, it should be understood that the invention is not limited to the disclosed embodiment. Rather, the invention should be interpreted in accordance with the claims which follow.

What is claimed is:

1. In an overlock sewing machine capable of selectively forming overedge stitches and double chain stitches, including a looper cover which is adapted to open said sewing machine so as to stretch threads over a looper mechanism and which is so moveable as to close said sewing machine to prevent said looper mechanism from being exposed, and a removable member removably supported on and fitted to said looper cover, said removable member selectively being a chip guard cover when overedge stitches are formed and said removable member selectively being an auxiliary bed when double chain stitches are formed, a safety device for said sewing machine comprising:

a stopper rigidly mounted on a frame of said sewing machine;

an engageable member provided on said removable member;

means for retaining said looper cover in an open condition, said retaining means abutting said stopper when said removable member is removed from said looper cover, and means for releasing said looper cover from said retaining means, said releasing means being moved by said engageable member to allow said looper cover to be movable to a closed position when said removable member is fitted to said looper cover; and a switch for generating a signal for starting said sewing machine in a position where said looper cover is closed.

2. In an overlock sewing machine capable of forming overedge stitches, including a looper cover which is adapted to open said sewing machine so as to stretch threads over a looper mechanism and which is so moveable as to close said sewing machine to prevent said looper mechanism from being exposed, and a chip guard cover supported on said looper cover when overedge stitches are formed and removable with respect to said looper cover, a safety device for said sewing machine comprising:

a stopper rigidly mounted on a frame of said sewing machine;

an engageable member provided on said chip guard cover;

means for retaining said looper cover in an open condition, said retaining means abutting said stopper when said chip guard cover is removed from said looper cover, and means for releasing said looper cover from said retaining means, said releasing means being moved by said engageable member to allow said looper cover to be movable to a closed position when said chip guard cover is fitted to said looper cover; and a switch for generating a signal for starting said sewing machine in a position where said looper cover is closed.

3. In an overlock sewing machine capable of forming double chain stitches, including a looper cover which is adapted to open said sewing machine so as to stretch threads over a looper mechanism and which is so moveable as to close said sewing machine to prevent said looper mechanism from being exposed, and an auxiliary bed supported on said looper cover when said double chain stitches are formed and removable with respect to said looper cover, a safety device for said sewing machine comprising:

a stopper rigidly mounted on a frame of said sewing machine;

an engageable member provided on said auxiliary bed;

means for retaining said looper cover in an open condition, said retaining means abutting said stopper when said auxiliary bed is removed from said looper cover, and means for releasing said looper cover from said retaining means, said releasing means being moved by said engageable member to allow said looper cover to be movable to a closed position when said auxiliary bed is fitted to said looper cover; and a switch for generating a signal for starting said sewing machine in a position where said looper cover is closed.

4. In an overlock sewing machine capable of selectively forming overedge and double chain stitches, including a looper cover which is adapted to open said sewing machine so as to stretch threads over a looper mechanism and which is so moveable as to close said sewing machine to prevent said looper mechanism from being exposed, a chip guard cover removably supported on said looper cover and to be fitted to said looper cover when overedge stitches are formed, and an auxiliary bed removably supported on said looper cover and to be fitted to said looper cover when double chain stitches are formed, a safety device for a sewing machine comprising:

a stopper rigidly mounted on a frame of said sewing machine;

engageable members provided on said chip guard cover and said auxiliary bed, respectively;

means for retaining said looper cover in an open condition, said retaining means abutting said stopper when said chip guard cover or said auxiliary bed is removed from said looper cover, and means for releasing said looper cover from said retaining means, said releasing means being moved by said engageable member to allow said looper cover to be movable to a closed position when said chip guard cover or said auxiliary bed is fitted to said looper cover, wherein said retaining means comprises a lever rotatably supported on said looper cover and a detention means for staying one end of said lever in a position that it is opposite to said stopper when said looper cover is in an open condition, and that said lever is caused to keep one end thereof away from said stopper by said engageable member and to be so rotatable as to release said detention means when said chip guard cover or said auxiliary bed is fitted to said looper cover; and a switch for generating a signal for starting said sewing machine in a position where said looper cover is closed.

5. In an overlock sewing machine capable of forming overedge stitches, including a looper cover which is adapted to open said sewing machine so as to stretch threads over a looper mechanism and which is so moveable as to close said sewing machine to prevent said looper mechanism from being exposed, and a chip guard cover supported on said looper cover when overedge stitches are formed and removable with respect to said looper cover, a safety device for said sewing machine comprising:

a stopper rigidly mounted on a frame of said sewing machine;

an engageable member provided on said chip guard cover;

means for retaining said looper cover in an open condition, said retaining means abutting said stopper when said chip guard cover is removed from said looper cover, and means for releasing said looper cover from said retaining means, said releasing means being moved by said engageable member to allow said looper cover to be moveable to a closed position when said chip guard cover is fitted to said looper cover, wherein said retaining means comprises a lever rotatably supported on said looper cover and a detention means for staying one end of said lever in a position that it is opposite to said stopper when said looper cover is in an open condition, and that said lever is caused to keep one end thereof away from said stopper by said engageable member and to be so rotatable as to release said detention means when said chip guard cover is fitted to said looper cover; and a switch for generating a signal for starting said sewing machine in a position where said looper cover is closed.

6. In an overlock sewing machine capable of forming double chain stitches, including a looper cover which is adapted to open said sewing machine so as to stretch threads over a looper mechanism and which is so moveable as to close said sewing machine to prevent said looper mechanism from being exposed, and an auxiliary bed supported on said looper cover when double chain stitches are formed and removable with respect to said looper cover, a safety device for said sewing machine comprising:

a stopper rigidly mounted on a frame of said sewing machine;

an engageable member provided on said auxiliary bed;

means for retaining said looper cover in an open condition, said retaining means abutting said stopper when said auxiliary bed is removed from said looper cover, and means for releasing said looper cover from said retaining means, said releasing means being moved by said engageable member to allow said looper cover to be moveable to a closed position when said auxiliary bed is fitted to said looper cover, wherein said retaining means comprises a lever rotatably supported on said looper cover and a detention means for staying one end of said lever in a position that it is opposite to said stopper when said looper cover is in an open condition, and that said lever is caused to keep one end thereof away from said stopper by said engageable member and to be so rotatable as to release said detention means when said auxiliary bed is fitted to said looper cover; and a switch for generating a signal for starting said sewing machine in a position where said looper cover is closed.

7. A safety device for an overlock sewing machine as described in claim 4, wherein said detention means comprises a pin opposite to the side end face of said lever and a spring for so applying a rotational force to said lever as to engage said lever with said pin.

8. A safety device for an overlock sewing machine as described in claim 5, wherein said detention means comprises a pin opposite to the side end face of said lever and a spring for so applying a rotational force to said lever as to engage said lever with said pin.

9. A safety device for an overlock sewing machine as described in claim 6, wherein said detention means comprises a pin opposite to the side end face of said lever and a spring for so applying a rotational force to said lever as to engage said lever with said pin.

* * * * *